US005718126A

United States Patent [19]

Capron et al.

[11] Patent Number: 5,718,126

[45] Date of Patent: Feb. 17, 1998

[54] PROCESS AND DEVICE FOR LIQUEFYING AND FOR PROCESSING A NATURAL GAS

[75] Inventors: Pierre Capron; Alexandre Rojey, both of Rueil Malmaison, France

[73] Assignee: Institut Francais du Petrole, Rueil-Malmaison, France

[21] Appl. No.: 727,778

[22] Filed: Oct. 8, 1996

[30] Foreign Application Priority Data

Oct. 11, 1995 [FR] France ..... 95 12002

[51] Int. Cl.[6] ..... F25J 3/00

[52] U.S. Cl. ..... 62/613; 62/614

[58] Field of Search ..... 62/613, 614

[56] References Cited

U.S. PATENT DOCUMENTS

| | | | |
|---|---|---|---|
| 3,531,942 | 10/1970 | La Fleur | 62/613 |
| 3,616,652 | 11/1971 | Engel | 62/613 |
| 4,128,410 | 12/1978 | Bacon . | |
| 4,476,695 | 10/1984 | Epps . | |
| 4,970,867 | 11/1990 | Herron et al. | 62/613 |
| 5,363,655 | 11/1994 | Kikkawa et al. | 62/613 |
| 5,365,740 | 11/1994 | Kikkawa et al. | 62/613 |
| 5,390,499 | 2/1995 | Rhoades et al. | 62/614 |
| 5,450,728 | 9/1995 | Vora et al. | 62/613 |

FOREIGN PATENT DOCUMENTS 2076029 10/1971 France .

*Primary Examiner*—Ronald C. Capossela

*Attorney, Agent, or Firm*—Antonelli, Terry, Stout, & Kraus, LLP

[57] ABSTRACT

A fluid consisting at least partly of a mixture of hydrocarbons is liquefied by means of the following stages:

the mixture under pressure is cooled so as to condense it at least partly to produce a liquid phase and a gas phase, and bringing into contact of at least a fraction of each of said phases is simultaneously achieved at least partly in a countercurrent flow so as to obtain, by matter transfer, a gas phase enriched in light hydrocarbons and a first liquid phase enriched in heavy hydrocarbons, and the two phases obtained thereby are separated and the gas phase enriched in light hydrocarbons is sent to a second cooling stage in order to obtain a second liquid phase enriched in light hydrocarbons.

15 Claims, 16 Drawing Sheets

PROCESS AND DEVICE FOR LIQUEFYING AND FOR PROCESSING A NATURAL GAS

FIELD OF THE INVENTION

The present invention relates to a process for liquefying and for fractionating a fluid or a gaseous mixture consisting at least partly of hydrocarbons, notably a natural gas.

BACKGROUND OF THE INVENTION

Natural gas is commonly produced in sites far away from places where it is to be used and it is common practice to liquefy it in order to convey it over long distances by means of LNG carriers or to store it in the liquid form.

The prior art describes many liquefaction processes that may comprise a stage of cryogenic fractionation of hydrocarbons other than methane. Embodiment examples are notably described in patents U.S. Pat. No. 3,763,658, U.S. Pat. No. 4,065,278 and in patent application EP-0,535,752.

When natural gas is liquefied, it is generally necessary to obtain separately, from the original gas, at least a fast liquid fraction containing at least part of the heaviest hydrocarbons mixed with the methane, and at least a second liquid fraction enriched in methane that constitutes the Liquefied Natural Gas produced.

It has been discovered, which is one object of the present invention, that the liquefaction and fractionation conditions of a natural gas can be improved by subjecting it simultaneously to an indirect heat exchange leading to the condensation of the constituents and possibly of the saturation water contained in the gas, and to a matter exchange during which, by contact between the gas phase and the condensed hydrocarbon liquid phase or phases, separation of the gas phase and of the constituents thereof is optimized.

A methane-rich gas phase depleted in heavy hydrocarbons and one or several hydrocarbon liquid or aqueous phases are then obtained.

SUMMARY OF THE INVENTION

The process according to the invention advantageously allows to increase the production yield of separated constituents, notably $C_3$+hydrocarbons.

It also allows to use the liquid hydrocarbon fractions obtained by fractionation to provide the makeups required for the coolant mixtures used in the cooling cycles of the process.

The present invention relates to a process for liquefying a fluid such as a gas consisting at least partly of a mixture of hydrocarbons, comprising at least the following stages:

said fluid under pressure is cooled so as to condense it at least partly in order to produce a liquid phase and a gas phase, and bringing into contact of at least a fraction of each of said phases is simultaneously achieved at least partly in a countercurrent flow in order to obtain, by matter transfer, a gas phase enriched in light hydrocarbons and a first liquid phase enriched in heavy hydrocarbons, the two phases obtained thereby are separated and the gas phase enriched in light hydrocarbons is sent to a second cooling stage in order to obtain a second liquid fraction enriched in light hydrocarbons.

During the precooling stage, the ascending gas phase is for example contacted with a descending liquid hydrocarbon fraction.

The cooling performed during the precooling stage can be provided by an at least partly continuous and countercurrent heat exchange in at least part of the zone where the phases are brought into contact.

During the precooling stage, at least two liquid fractions having different compositions are for example drawn off at different levels.

According to a first embodiment of the process, the precooling stage and the final liquefaction stage are carried out by means of two different cooling cycles, each of the cycles working with its own cooling mixture, the cooling mixture used during the final liquefaction stage being, for example, partly condensed during the precooling stage.

According to another embodiment of the process, the precooling stage and the final liquefaction stage are carried out by means of a single cooling cycle working with a cooling mixture.

The precooling stage is carried out in the presence of a solvent. The solvent is for example injected into the gas.

The process according to the invention is particularly well-suited for the liquefaction of a natural gas, or to obtain a cooling mixture providing the liquefaction of a natural gas obtained at least partly by vaporization of at least a liquid fraction of a mixture of hydrocarbons obtained by implementing the process according to the invention.

The present invention further relates to a plant intended for the liquefaction of a fluid such as a gas consisting at least partly of a mixture of hydrocarbons.

It is characterized in that it comprises at least one precooling device including:

a cooling circuit allowing to condense, by heat exchange, at least part of the heavy hydrocarbons contained in the fluid so as to obtain a liquid hydrocarbon fraction, at least one line for delivering said fluid to be processed, connected to at least one main circuit allowing the gas phase and said liquid hydrocarbon fraction to be brought into direct contact at least partly in a countercurrent flow, the heat exchange between said cooling circuit and said main contact circuit, and the direct countercurrent contact of said gas phase and of the liquid hydrocarbon fraction allowing to obtain a methane-rich gas phase depleted in heavy hydrocarbons, at least a first discharge line for sending said methane-rich gas phase to a second cooling stage and at least a second line for discharging the liquid phase.

At the end of the second cooling stage, the fluid to be processed, natural gas for example, is liquefied.

The cooling device includes at least one means for drawing off said liquid hydrocarbon fractions.

The plant comprises for example means for stabilizing said liquid hydrocarbon fractions, said stabilization means being connected to said draw-off means.

The precooling device can comprise at least one injection means allowing injection of a fluid other than gas. The fluid can be a solvent injected into the gas in order to process it, the solvent can also be selected to be used as a separation agent.

The precooling device comprises for example a vertical plate exchanger in which the ascending fluid or gas to be processed is brought into contact with a liquid fraction flowing downwards by gravity.

The plant can include a precooling device comprising a brazed aluminium plate exchanger and a final liquefaction device including a stainless steel plate exchanger.

The invention thus affords the advantages as follows:

by reducing the carry-over of relatively heavy constituents in the gas from the precooling stage and by thus preventing risks of crystallization in the coldest part of the process, it improves the working safety of the process, by optimizing the fractionation of the natural gas so as to obtain a natural gas to be processed containing mainly methane and highly depleted in other constituents, it increases the production yield of LNG on the one hand and of the separated hydrocarbon fractions on the other hand, it leads to a cost decrease due to the decrease in the equipment and to a saving of space in the process facilities, it allows liquid hydrocarbon fractions obtained during the precooling stage to be used as constituents of a cooling mixture.

BRIEF DESCRIPTION OF THE DRAWINGS

Other features and advantages of the invention will be clear from reading the description hereafter of embodiments given by way of non limitative examples of applications to the processing of a natural gas, with reference to the accompanying drawings in which.

DESCRIPTION OF THE INVENTION

Figure 1:
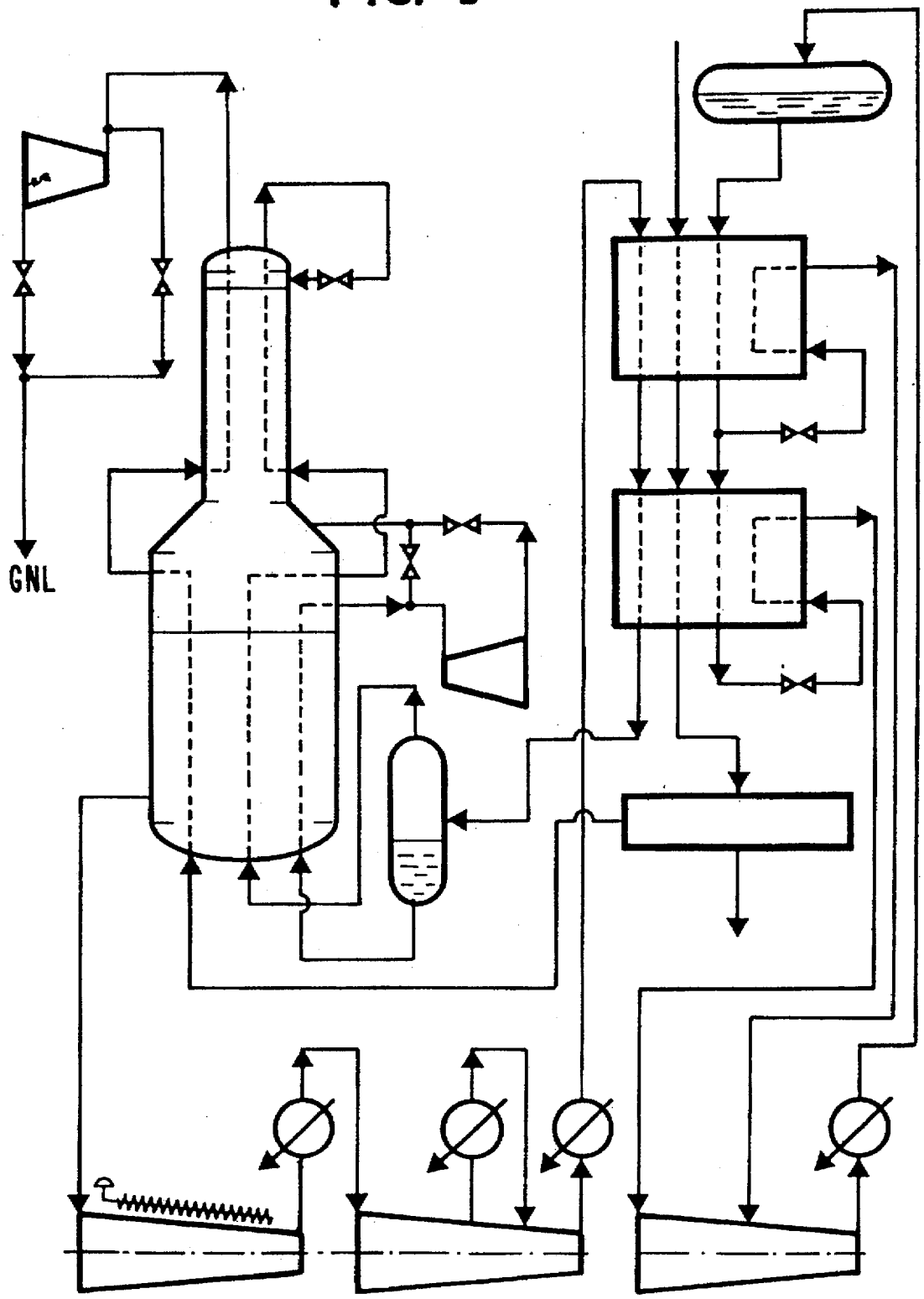
FIG. 1 diagrammatically shows an example of a liquefaction cycle as described in the prior art.

The flowsheet of a process used in the prior art for liquefying a natural gas is briefly shown in FIG. 1.

The liquefaction process comprises a precooling cycle allowing the heaviest hydrocarbons contained in the natural gas and in the mixture used in the main cooling cycle to be partly condensed. These two cycles use a fluid mixture as the coolant which, on vaporizing, liquefies the natural gas under pressure. After vaporization, the mixture is compressed, condensed by exchanging heat with the ambient medium such as available water or air and recycled.

After the precooling stage after which the heaviest fractions of the natural gas have condensed, the two-phase mixture is fed into a separation unit that provides, on the one hand, a gaseous fraction depleted in heavy hydrocarbons, i.e. mainly consisting of methane and/or nitrogen, and on the other hand one or several liquid cuts of higher molecular weight. These liquid cuts or fractions can be made as narrow as required by feeding them through an array of fractionating columns. The gaseous fraction is sent to a final cooling stage to be liquefied.

It has been discovered, which is one object of the present invention, that it is possible to purify the gaseous fraction, i.e. to remove the heavy hydrocarbons, during the precooling stage and to obtain directly at the end of this stage a methane-rich gas phase or gaseous fraction depleted in heavy hydrocarbons. Separation of the heavy hydrocarbons from the gas phase is advantageously carried out by heat exchange and by contacting the gas phase and the hydrocarbons condensed by the heat exchange.

The principle implemented in the invention described hereafter consists in precooling a natural gas by causing simultaneously the condensation of a liquid hydrocarbon fraction and by contacting, preferably in a countercurrent flow, the liquid hydrocarbon fractions with the gas.

Separation of the gas phase constituents is thus optimized in order to obtain a methane-rich phase depleted in heavy hydrocarbons.

Condensation of the hydrocarbons and contacting them, preferably in a countercurrent flow, with the gas is advantageously achieved during an indirect heat exchange operation.

Figure 2A:
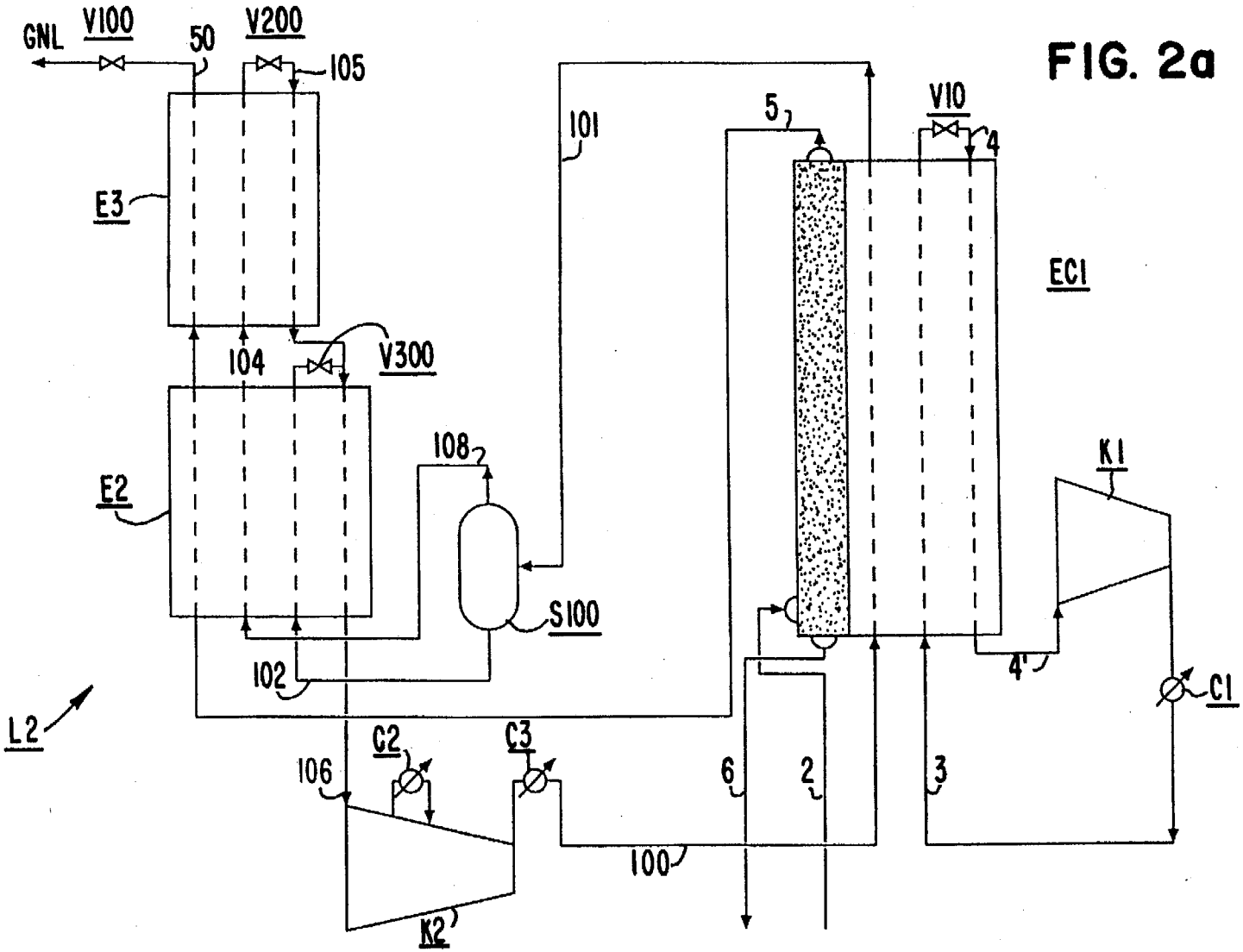
FIGS. 2A and 2B show a flowsheet of a liquefaction process including a precooling cycle according to the invention, and an example of the precooling circuit.

The principle of the process is illustrated in FIG. 2A and applied, by way of example, to a natural gas containing hydrocarbons other than methane, notably $C_3$+hydrocarbons.

The gas to be processed is fed into an enclosure EC1 such as a heat exchanger through a line 2 situated in the lower part thereof.

It circulates in the exchanger in a main circuit allowing matter exchange or transfer between the ascending gas to be processed, for example, and the hydrocarbons condensed by cooling and exhibiting a descending countercurrent flow.

It is simultaneously cooled by indirect heat exchange, for example through a wall (FIGS. 7, 8), for example by a cooling mixture that enters exchanger EC1 through line 3 and, after subcooling and expansion through relief valve V10, flows back into the exchanger through line 4, is vaporized progressively in a descending circulation so as to decrease the temperature of the gas to be processed and flows out through line 4' to be compressed in compressor K1, cooled and at least partly condensed by heat exchange with cooling water or air in exchanger C1 and recycled to exchanger EC1.

Cooling of the natural gas causes the condensation of the heavy hydrocarbons contained in the gas. The condensed liquid hydrocarbon phase or phases flow downwards in the exchanger by gravity, in a countercurrent flow with respect to the gas to be processed, that is progressively depleted in propane, butane and heavy hydrocarbons because of the matter exchange. On the other hand, the condensed liquid hydrocarbon phase becomes gradually richer in heavier constituents.

The methane-rich gas phase depleted in propane, butane and heavy hydrocarbons is discharged through a line 5 at the top of the exchanger and sent to a second cooling stage or final liquefaction stage schematized in FIG. 2A by reference L2.

The temperature variation or the temperature gradient caused in the exchanger are for example selected according to the nature of the gas and to the amount of condensed hydrocarbons, such as LPG and natural gasoline, to be recovered.

Similarly, the lowering of the temperature of the gas to be processed is preferably achieved in order to obtain a temperature gradient in the whole exchanger.

In the case of the example illustrated in FIG. 2A, the two cooling stages are carried out by means of two independent cooling cycles. The final liquefaction stage is for example carried out as follows:

The natural gas flowing out of exchanger EC1 through line 5 is fed into exchanger E2 where it is liquefied, then into exchanger E3 where it is subcooled. It flows out of exchanger E3 through line 50 and is expanded through relief valve V 100 to form the LNG produced. Cooling in exchangers E2 and E3 is provided for example by a cooling mixture that is compressed by means of compressor K2, cooled by means of cooling water or air in exchangers C2 and C3. The cooling mixture is fed into exchanger EC1 through line 100 and leaves the latter, partly condensed, through line 101. The liquid phase and the vapour phase are separated in phase separator S 100. The liquid cooling mixture from separator S 100 is fed, through line 102, into exchanger E2 where it is subcooled, and expanded through relief valve V 300.

The vapour cooling mixture coming from separator S 100 is fed, through line 103, into exchanger E2 where it is liquefied. The liquid cooling mixture thus obtained is sent, through line 104, from exchanger E2 to exchanger E3 where it is subcooled prior to being expanded through relief valve V 200 and sent back, after expansion, into exchanger E3 through line 105. Its vaporization, at least partial, in exchanger E3 provides the subcooling of the LNG prior to expansion and the subcooling of the cooling mixture.

It flows out of exchanger E3 to be mixed with the cooling mixture fraction coming from exchanger E2 and expanded through relief valve V 300. The mixture obtained thereby is vaporized in exchanger E2, thus providing the required cooling of the natural gas and of the cooling mixture, and leaves exchanger E2 through line 106, in the vapour phase, in order to be sent to compressor K2.

The cooling cycle used during the precooling stage can use various layouts without departing from the scope of the invention.

Figure 2B:
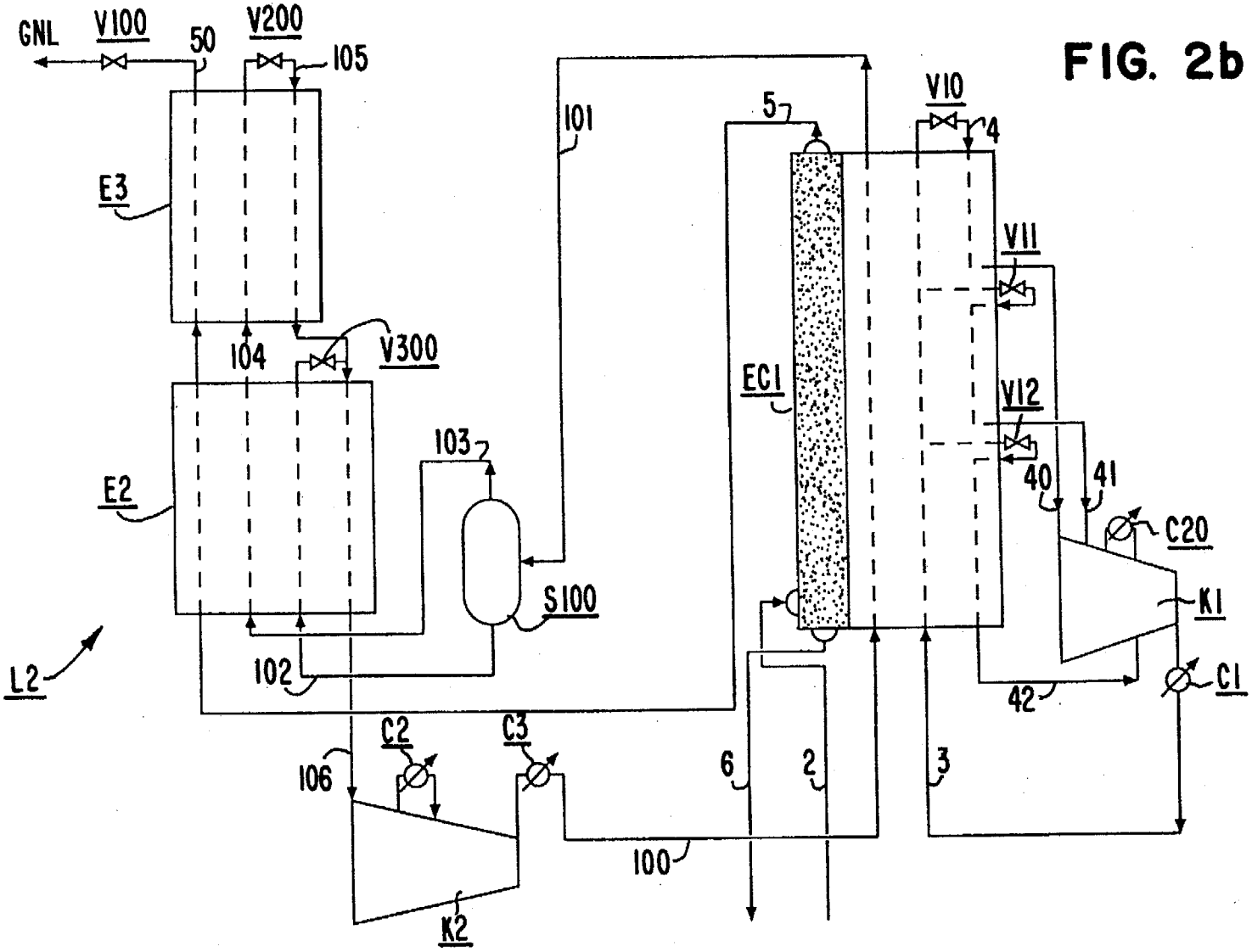

FIG. 2B shows a first layout example where the cooling mixture used during the precooling stage is condensed by means of cooling water or air in exchanger C1. The liquid cooling mixture obtained thereby is fed, through line 3, into exchanger EC1 where it is subcooled. It is expanded at increasingly lower pressure levels through relief valves V 12, V 11 and V 10, the vapour fractions obtained after each vaporization being sent to compressor K1 through lines 40, 41 and 42. Compressor K1 is cooled by means of exchanger C20 with the aid of cooling water or air. This layout allows to reduce the compression power required, the maximum compression ratio of compressor K1 being only applied to the mixture fraction used for cooling in the lowest temperature zone of exchanger EC1.

Lowering of the temperature, according to a given gradient in exchanger EC1, allows to condense in distinct zones the different hydrocarbon fractions contained in the natural gas, the heaviest fractions being recovered at the bottom of the exchanger and the other fractions can be recovered at intermediate levels between the top and the bottom of the exchanger. Such an embodiment variant is described in connection with FIG. 3.

In order to recover for example the LPG fraction that contains the propane and the butanes (hydrocarbons with three or four carbon atoms), and separately the natural gasoline representing the C5+fraction, exchanger EC1 includes at least one recovery means, for example a tray 7 delimiting for example two zones Z1 and Z2. This tray communicates with the natural gas flow circuit or circuits of each of the zones and with a line 8 for discharging the separated hydrocarbon fraction recovered at the level of tray 7. This hydrocarbon fraction enriched in propane and butane corresponds to the hydrocarbons that have condensed in zone Z2.

The liquid hydrocarbon phase that has not been recovered at the level of tray 7 is redistributed in zone Z1 so as to flow downwards toward the bottom of the exchanger.

The latter is for example provided with a line 9 situated in the lower part thereof for discharging the natural gasoline fraction.

The exchanger can be equipped with several recovery trays distributed for example according to the nature of the cuts or hydrocarbons to be recovered, to their volatility and/or to the temperature prevailing at various points of the exchanger.

Figure 4A:
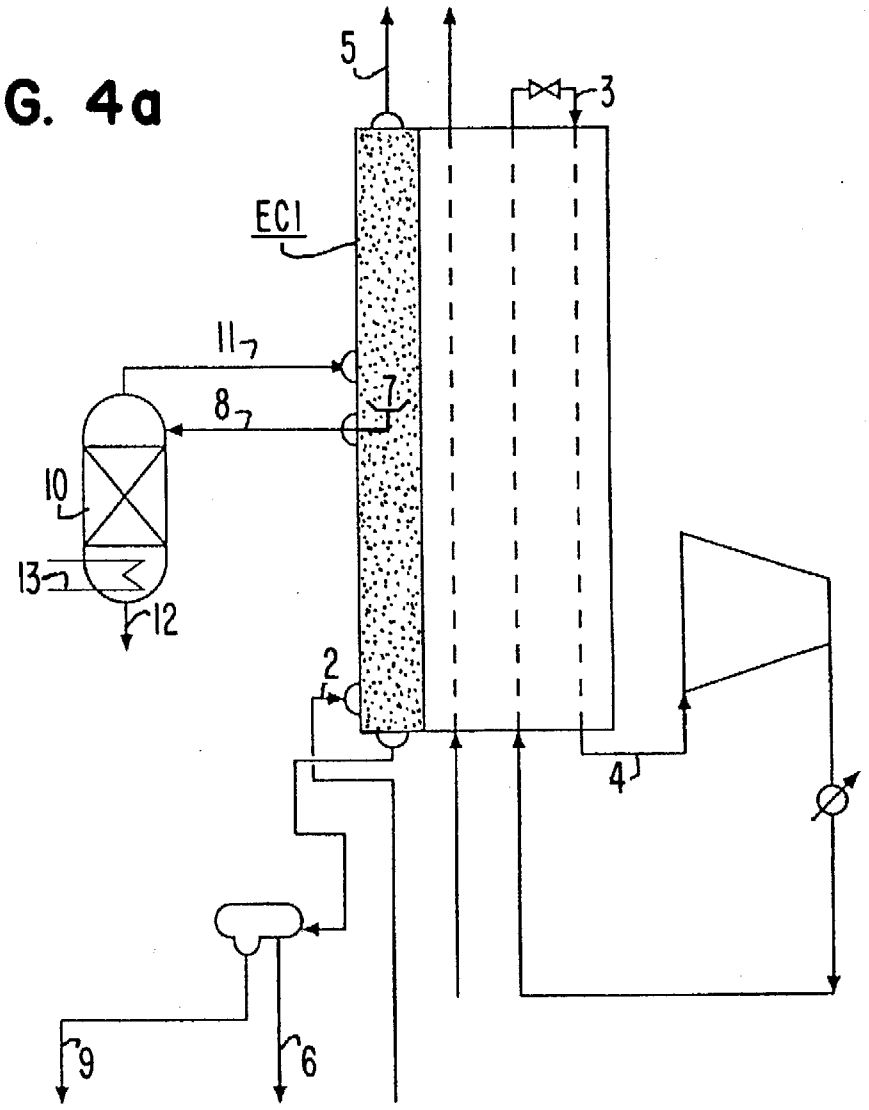
FIGS. 4A, 4B and 4C show several examples of coupling of stabilization means with the precooling device to achieve stabilization of the separated fractions, FIGS. 5A, 5B and 5C diagrammatically show various cooling processes for the precooling and cooling cycle or cycles.
Figure 4B:
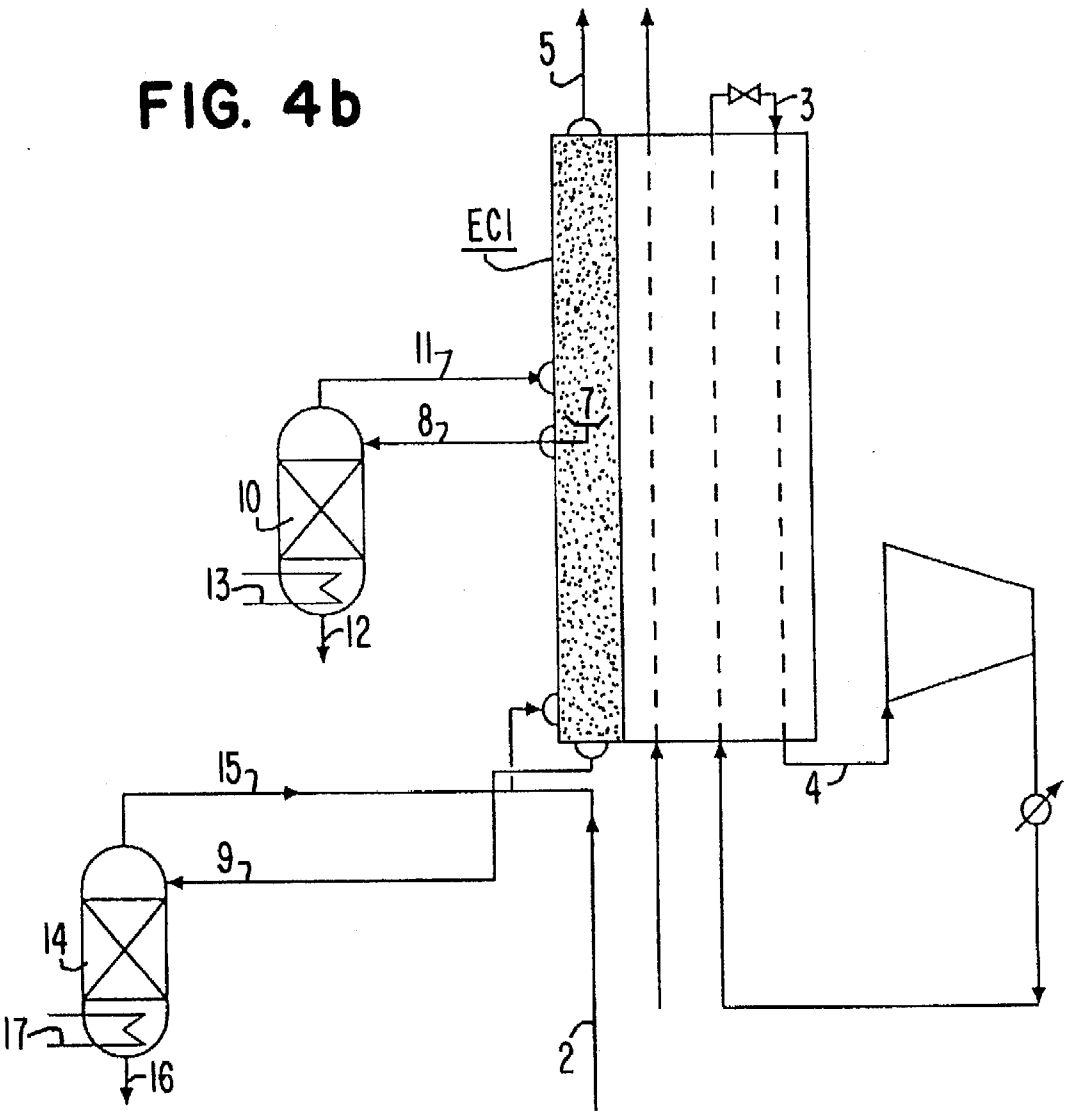
Figure 4C:
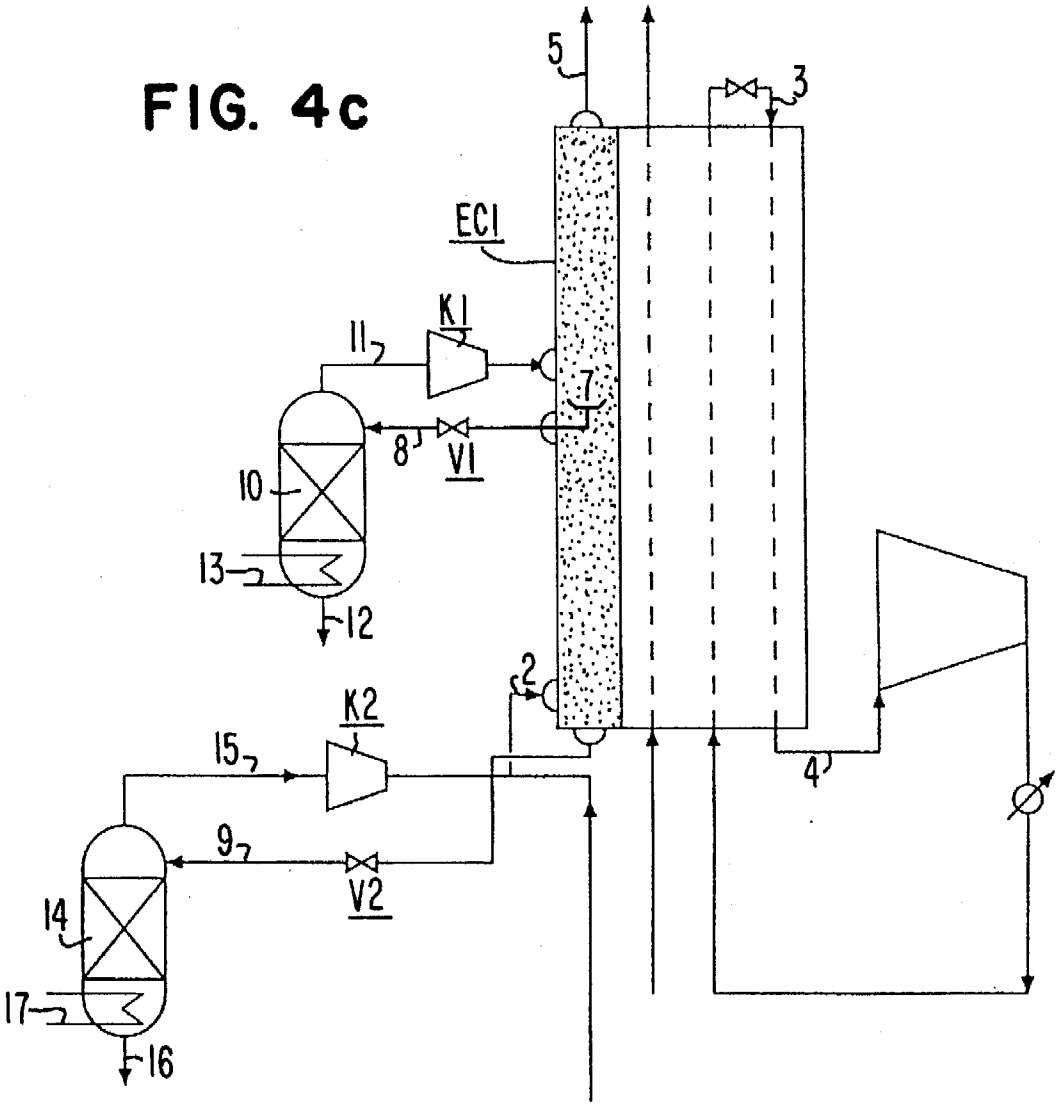

According to a preferred embodiment of the invention, the liquid hydrocarbon phases thus recovered are stabilized according to the processes described in FIGS. 4A, 4B and 4C.

A first embodiment (not shown) consists in using a means for heating the liquid volume collected at the bottom, for example a reboiler B1 integrated in the lower part of the exchanger and that is not shown in the figures. By stabilizing the natural gasoline fraction, the methane and ethane production yield is notably improved.

Figure 3:
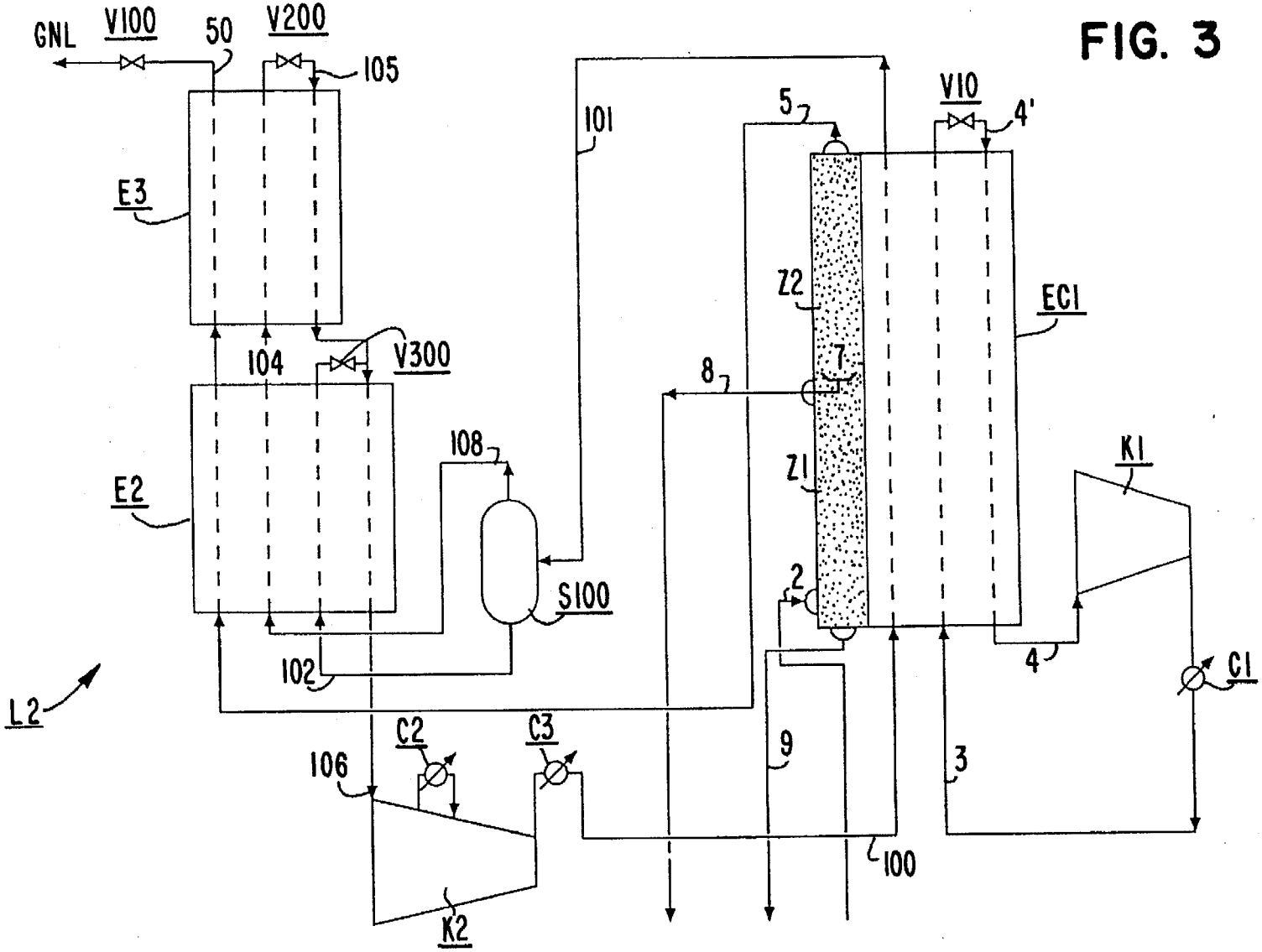
FIG. 3 shows an embodiment variant allowing selective fractionation of one or several natural gas constituents.

In FIG. 4A, the discharge line 8 communicating with tray 7 intended for the recovery of the condensed LPG, described in FIG. 3, is connected to a device 10 allowing the stabilization thereof.

The complementary stabilization process consists in sending, into stabilization device 10, the condensate fraction containing methane and ethane in small amounts and mainly consisting of a LPG fraction recovered at the level of tray 7. The gaseous fraction rich in methane and ethane produced during stabilization is discharged through a line 11 and recycled to exchanger EC1 at the level of tray 7 in order to be recovered and mixed with the gas to be processed.

The stabilized LPG fraction is discharged at the bottom of the stabilization device, at the level of reboiler 13, through a line 12.

Such a procedure advantageously allows to stabilize the LPG-rich fraction before it is recovered by the producer and thus to increase the methane and ethane production yield.

In FIG. 4B, the plant described in FIG. 4A comprises a second stabilization device 14 for stabilizing the natural gasoline discharged through line 9.

The operational pattern is identical to that described in connection with FIG. 4A, the condensate discharged through line 9 mainly containing natural gasoline is fed into stabilization device 14.

The stabilized natural gasoline, mainly consisting of the $C_5$+fraction, is discharged through line 16 at the level of reboiler 17.

The gaseous fraction mainly consisting of methane, ethane, propane and butane is discharged out of the device through line 15 in order to be recycled and mixed again with the gas to be processed and flowing in through line 2.

These procedures advantageously allow to stabilize the LPG fractions and the natural gasoline fraction before they are recovered by the producer, and therefore to increase the overall efficiency of the process.

It is also possible to carry out stabilization of the LPG fractions and of the natural gasoline produced and separated during the process at a lower pressure.

To that effect, the plant described in FIG. 4C differs from that of FIG. 4A in two additional relief valves V1 and V2 respectively situated on discharge lines 8 and 9.

The gaseous fractions coming from stabilization devices 10 and 14 are recompressed through means such as compressors K1 and K2 prior to being sent back, through a line 16, to the gas to be processed at the level of line 2.

Stabilization of the various fraction advantageously allows to increase the production yield of upgradable compounds such as the LPG fraction and natural gasoline and, on the other hand, to be able to use them as constituents of a cooling fluid in the liquefaction process.

When the temperature of the natural gas is higher than its dew point, it may be advantageous to cool it down to a temperature close to its dew point during a first cooling stage prior to sending it into exchanger EC1. The layout represented in FIG. 5A may for example be used. In this case, a fraction of the cooling mixture is expanded to an intermediate pressure level through relief valve V 30 and vaporized to obtain the cooling required for the natural gas.

The principle of the process according to the invention will be clear from reading example 1 hereunder, described in connection with FIG. 5A hereafter and given by way of non limitative example.

EXAMPLE 1

A natural gas at a pressure of 4 MPa and at a temperature of 35° C. is fed into exchanger E1 through line 2. The composition of the natural gas, expressed in molar fractions, is as follows:

Methane: 87.3%
Nitrogen: 4.2%
Ethane: 5.3%
Propane: 1.8%
Isobutane: 0.4%
n-butane: 0.5%
$C_5$+: 0.5%.

The natural gas is cooled down to −15° C. in exchanger E1. It is thereafter fed into exchanger EC1 through line 3' which it leaves through line 101 at −55° C. A liquid fraction is taken at the bottom through line 6 and a LPG-richer intermediate fraction is drawn off at −45° C. through the line. The top gas, as well as the two liquid fractions drawn off, have the compositions as follows (in molar %):

| | Top gas | Bottom liquid | Intermediary liquid drawn off |
|---|---|---|---|
| Methane | 89.30 | 26.33 | 39.36 |
| Nitrogen | 4.32 | 0.36 | 0.51 |
| Ethane | 4.96 | 9.39 | 16.65 |
| Propane | 1.24 | 12.09 | 21.74 |
| Isobutane | 0.10 | 6.07 | 8.14 |
| n-butane | 0.06 | 15.28 | 13.20 |
| Isopentane | / | 12.58 | 0.37 |
| n-pentane | / | 10.30 | / |
| $C_6$+ | / | 7.60 | / |

If it had been operated according to the prior art, by cooling the gas down to −55° C. and by collecting the gas and liquid phases thus obtained after such a cooling stage, the percentage of heavy hydrocarbons carried over in the gas would be much higher than with the process according to the invention. For example, the isopentane content would be of the order of 100 ppm instead of about 1 ppm with the process according to the invention. Similar differences are observed for the other heavy constituents contained in the gas.

Figure 5A:
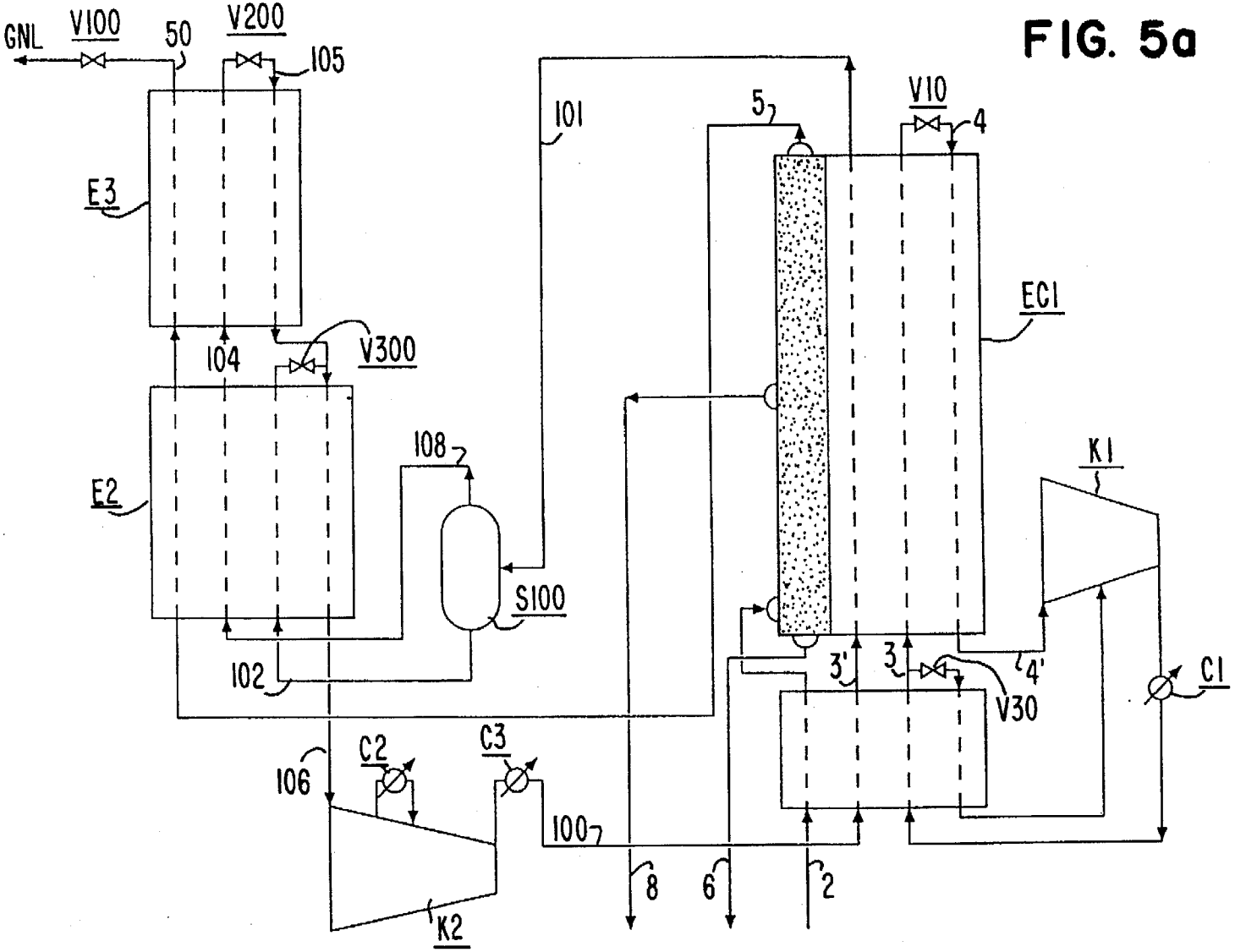
Figure 5B:
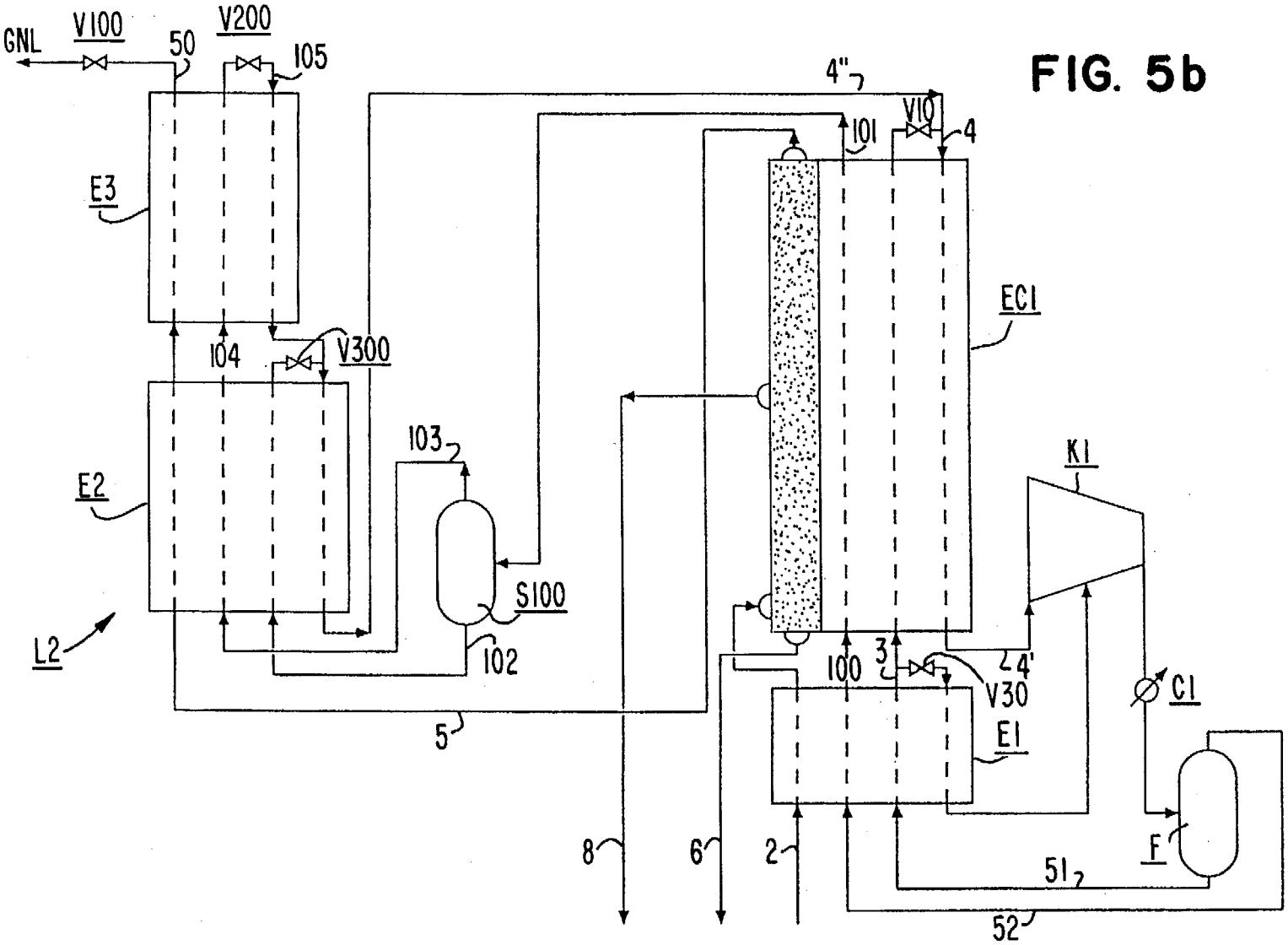
Figure 5C:
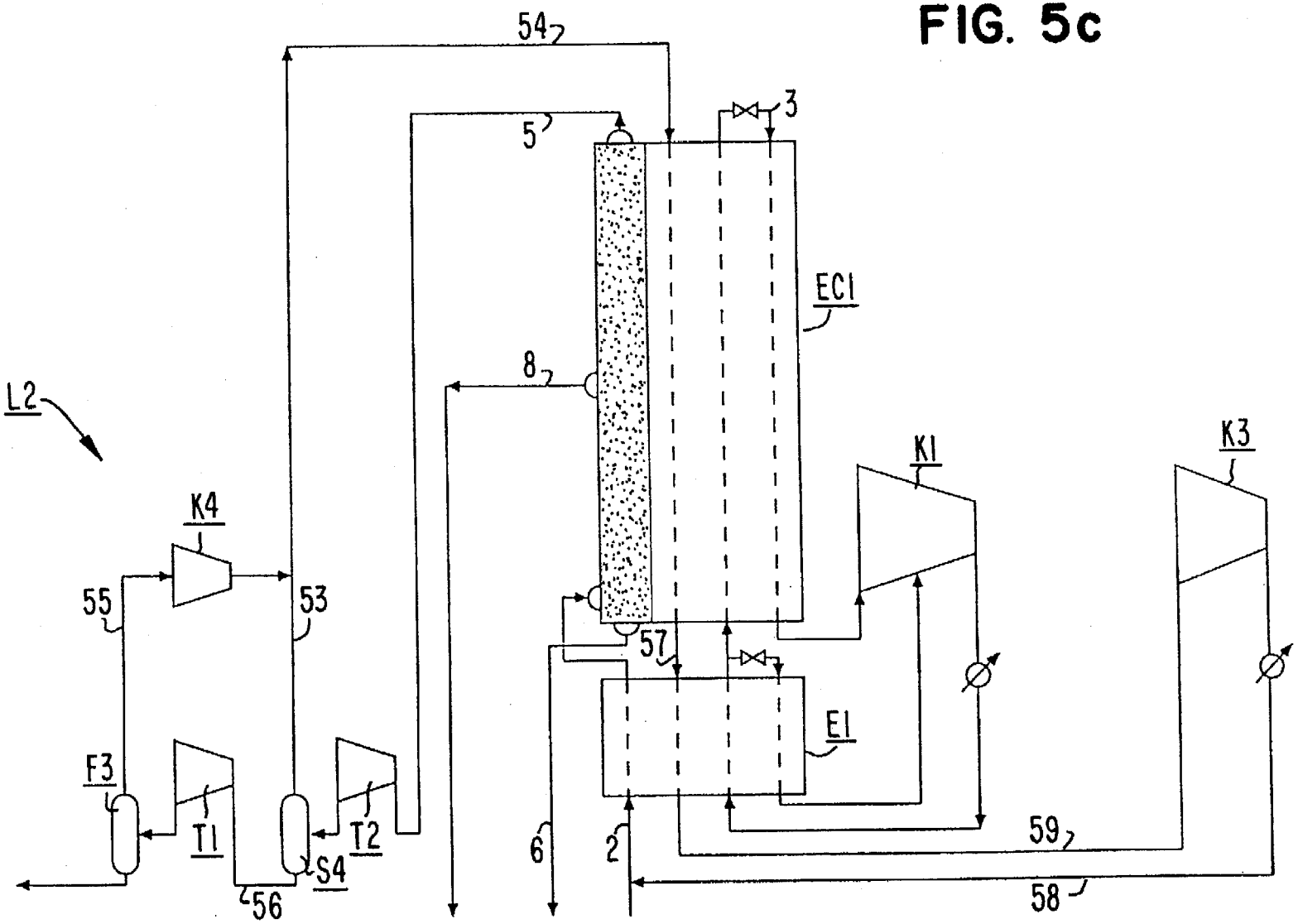

Cooling of the first and of the second natural gas liquefaction stage can be carried out in a dependent or independent way, according to examples given hereafter by way of non limitative examples in connection with FIGS. 5A, 5B and 5C.

FIG. 5A shows an embodiment variant of the process previously described in FIG. 2A, comprising an intermediate separation stage and for which the two cooling stages of the process are carried out with independent cooling mixtures.

According to another embodiment variant described in FIG. 5B, precooling of the gas in exchanger EC1 and that of the final liquefaction stage producing the Liquefied Natural Gas (LNG) is performed with the same mixture of coolants.

The cooling mixture circulating in cycle (K1, C1) is sent to a separator F where it is separated into a vapour fraction containing the light fractions of the mixture and into a liquid fraction containing the heavy fractions.

The heavy fractions, condensed by cooling by means for example of cooling water or air, are discharged at the bottom of separator F and fed, through lines 51 and 3, into exchanger EC1 to form a first cooling fluid, after passing for example through exchanger E1. By circulating in exchanger EC1, this first fluid provides precooling of the gas according to the process described for example in FIG. 2A so as to obtain, at the top of the exchanger, a gas mainly stripped from heavy hydrocarbons and rich in methane. This gas is then sent to the final liquefaction stage.

The light fractions coming from separator F through line 52 and forming a second cooling fluid are fed into exchanger EC1 through line 100. This second fluid is at least partly condensed in the exchanger by heat exchange with the first fluid consisting of the above-mentioned heavy fractions. This second fluid is then sent, through line 101, to the final liquefaction stage in order to obtain the Liquefied Natural Gas (LNG). After heat exchange in the final liquefaction stage L2, the second fluid is sent, through line 4", from the exchanger E2 of the final liquefaction cycle to line 4, in order to be mixed with the first fluid prior to being sent back to cycle (K1, C1) through line 4', after passing through exchanger EC1.

FIG. 5C describes another embodiment of the invention where precooling of the gas is performed at least partly by recycling a fraction of the gas stripped from the heavy constituents and by a first cooling mixture as described in FIG. 2A.

To that effect, the gas stripped from the heavy fractions is sent through line 5 to the final liquefaction stage L2 where it is fast expanded in a turbine T1 according to a process described for example in detail in the claimant's patent application FR-94/02,024, prior to being fed into a separator F2.

The vapour fraction obtained is sent through a line 53 to a line 54 intended for feeding it into exchanger EC1. The liquid fraction leaving the bottom of separator F2 through line 56 is expanded in one or several turbines T6 prior to being sent to a second separator F3.

The LNG produced, that is thereafter fed into line 57, is obtained at the outlet of separator F3, as well as a vapour fraction discharged through line 55 towards a compression device K4. This recompressed vapour fraction is then fed into line 53 to be mixed with the first fraction.

The mixture of the two fractions is thereafter introduced at the top of exchanger EC1 through line 54. It flows out at the bottom of exchanger EC1 after warming up and thus after performing part of the precooling of the natural gas. It is sent, through line 57 for example, into exchanger E1 where it is used as a cooling agent and it is sent from this exchanger, through line 59, into a compressor K3 prior to being cooled in a condenser. At the outlet of the condenser, it is fed into line 58 to be recycled with the gas to be processed.

In some cases, the tightness of the cooling circuits is not perfect, for example when the compression devices used are not entirely sealed. It is then necessary to compensate these mixture losses for example by adding a makeup cooling mixture.

This makeup is advantageously added by using at least partly the hydrocarbon cuts fractionated and recovered according to the process described in FIG. 3 for example.

These cuts can be advantageously stabilized prior to being used as constituents of a mixture of coolants, for example in the precooling stage and/or in another stage of the liquefaction process.

Figure 6A:
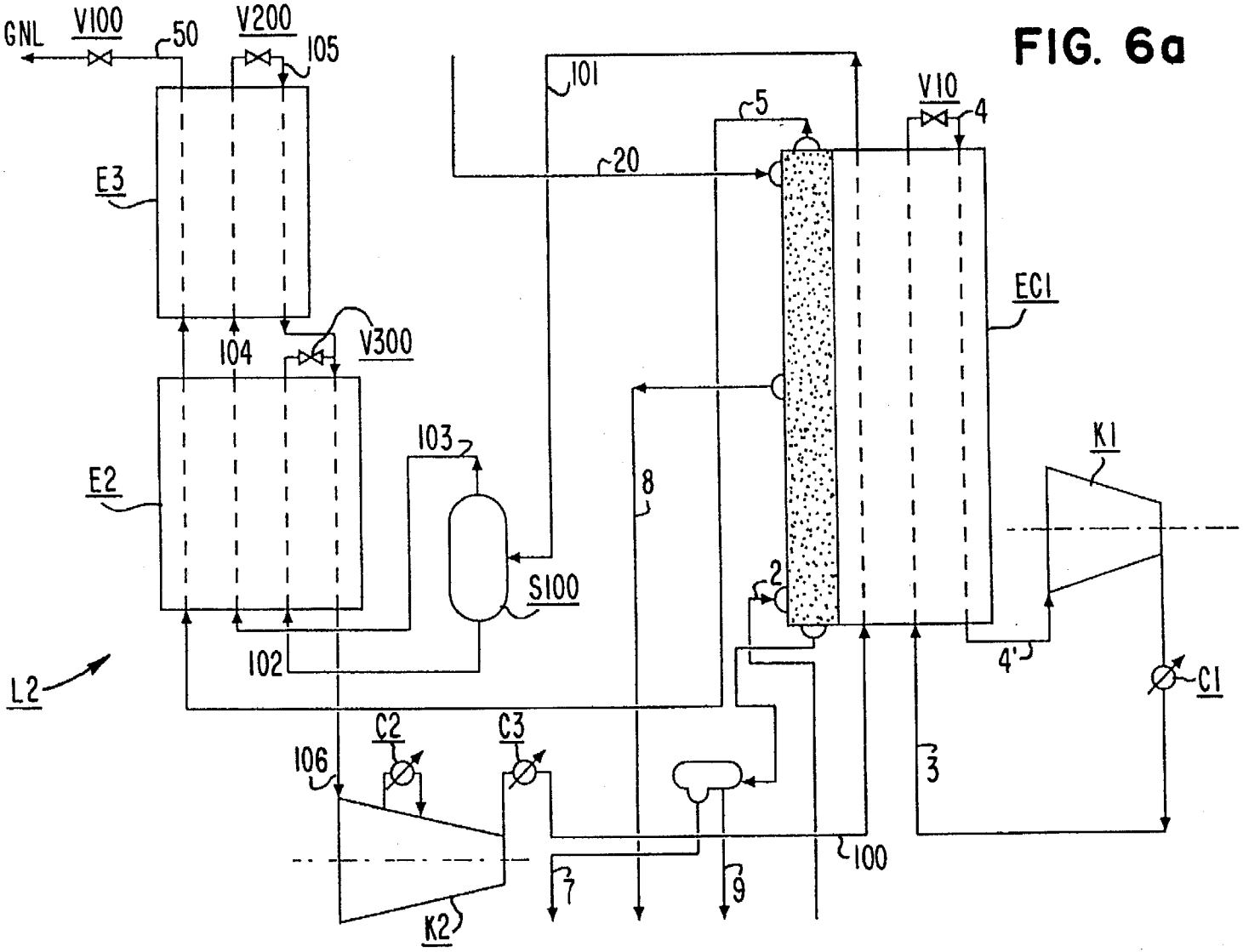
FIGS. 6A and 6B show two embodiment variants allowing injection of a solvent and/or of a fluid other than gas.

In some cases, it is also interesting to subject the natural gas to another processing than fractionation by operating for example according to the embodiment described in FIG. 6A.

Injection of a determined mount of solvent allows to achieve dehydration of the natural gas as well as the fractionation thereof.

To that effect, the device of FIG. 2A is provided of at least one delivery line 20 preferably situated at the level of the exchanger head.

Inside the exchanger, the gas is simultaneously contacted, preferably continuously and in a countercurrent flow, with the liquid phase containing the solvent circulating downwards, and cooled by indirect heat exchange according to one of the processes described above.

This cooling causes the condensation of the heavy hydrocarbons contained in the gas and of part of the saturation water of the gas. These two condensed liquid phases circulate in the device in a descending flow by gravity and in a countercurrent flow with respect to the processed gas that becomes progressively poorer in heavy compounds ($C_3$+ and higher) because of the matter exchange between the gas phase and the liquid hydrocarbons. The condensed liquid hydrocarbon phase becomes progressively richer in heavier constituents as it flows downwards and the solvent-rich condensed aqueous phase at the top of the exchanger becomes poorer in solvent by contact with the gas.

After decanting the aqueous phase is discharged through line 7 and the liquid hydrocarbon phase is discharged through line 9.

These two phases are for example thereafter processed separately according to their use or to their mode of transportation, or according to specifications given by the producer or the consumer.

The vaporized solvent carried along in the gas phase allows hydrate formation problems due to cooling to be prevented.

A solvent that is at least partly miscible with water is used. Its boiling-point temperature is preferably lower than that of water or it forms with the water an azeotrope whose boiling-point temperature is lower than that of water so that it may be carried along by the non-condensed gas.

This solvent is for example an alcohol and preferably methanol. It may also be selected from the following solvents: methylpropylether, ethylpropylether, dipropylether, methyltertiobutylether, dimethoxymethane, dimethoxyethane, ethanol, methoxyethanol, propanol, or it may be selected from various solvent classes such as, for example, amines or ketones, or a mixture made from one or several of these products.

The amount of solvent to be injected is usually adjusted according to the temperature, the pressure and/or the composition of the gas in order to prevent the formation of hydrates and the formation of frazil crystals due to the presence of water.

Thus, for example, the molar ratio of the flow of solvent to the flow of processed gas ranges between 1/1000 and 1/10.

The treating process is advantageously optimized by adjusting the amount of solvent injected according to a parameter relative to the gas, for example its temperature and/or its temperature variation and/or its composition and/or its pressure and/or the operating conditions. The temperature and/or the temperature gradient values measured by temperature detectors situated at the level of the exchanger are for example taken into account therefore.

Operations performed thereafter on the processed gas from the enclosure are preferably also taken into account.

By countercurrent circulation, the gas carries along the solvent contained in the liquid phases that circulate downwards by gravity. These liquid phases are collected at the bottom, substantially stripped from solvent. The solvent injected at the top is thus mainly discharged in the gas phase leaving the exchanger head. The amount of solvent injected may thus be adjusted in order to obtain the level of concentration required in this gas phase to prevent hydrate formation, considering the temperature and pressure conditions.

The solvent injected at the top is not necessarily pure and it may be, for example, mixed with water, provided that the solvent concentration in the aqueous phase allows hydrate formation to be prevented.

Injection of a solvent through line 20 also allows to remove constituents other than water. Unwanted aromatic hydrocarbons likely to crystallize can for example be removed by injecting a solvent that eliminates them selectively. The solvent can be, in this case for example, a polar solvent such as, for example, an ether, an alcohol or a ketone.

A solvent consisting of a hydrocarbon cut can also be injected through line 20 to eliminate hydrocarbons present in the gas.

This notably allows to eliminate the heavy hydrocarbons present in the gas when the latter is at a high pressure, higher than the cricondenbar value, condensation by cooling being in this case very difficult or even impossible to achieve.

Figure 6B:
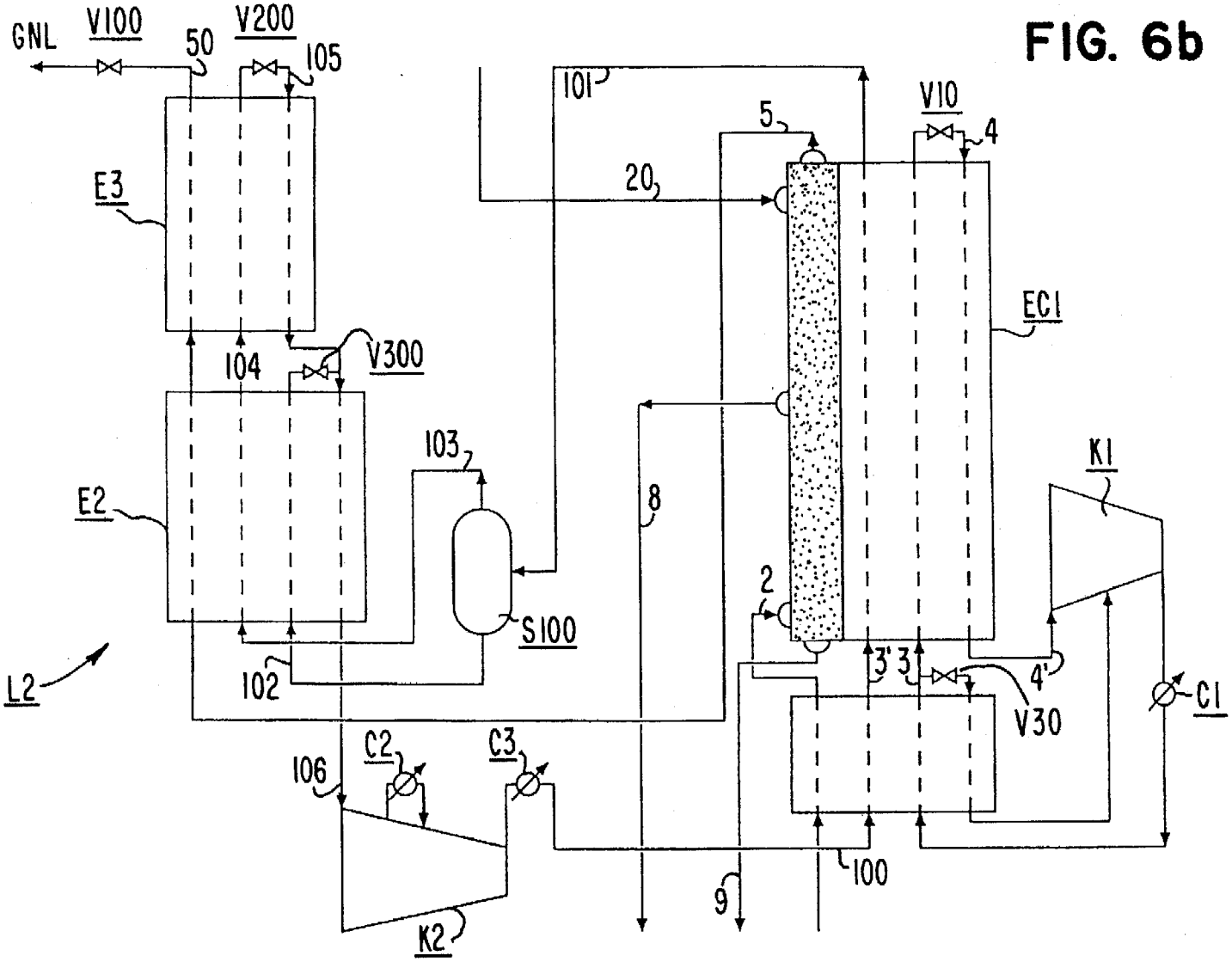

FIG. 6B describes an embodiment allowing injection of a separation agent, for example a solvent, through line 20.

The gas is initially cooled in an exchanger E1 prior to being sent to exchanger EC1.

Figure 6C:
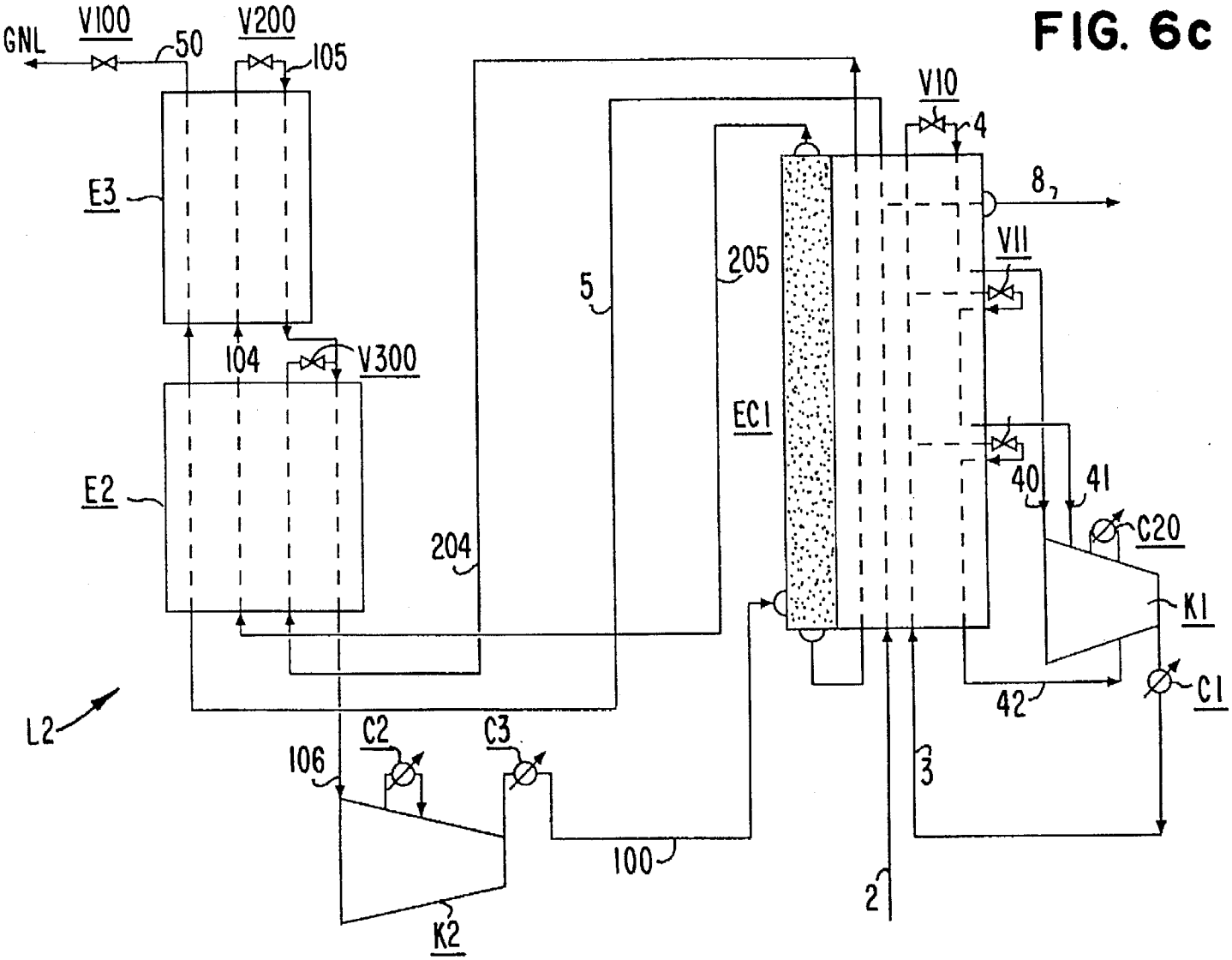
FIGS. 6C and 6D show two embodiment variants of the process according to the invention applied to a cooling mixture.
Figure 6D:
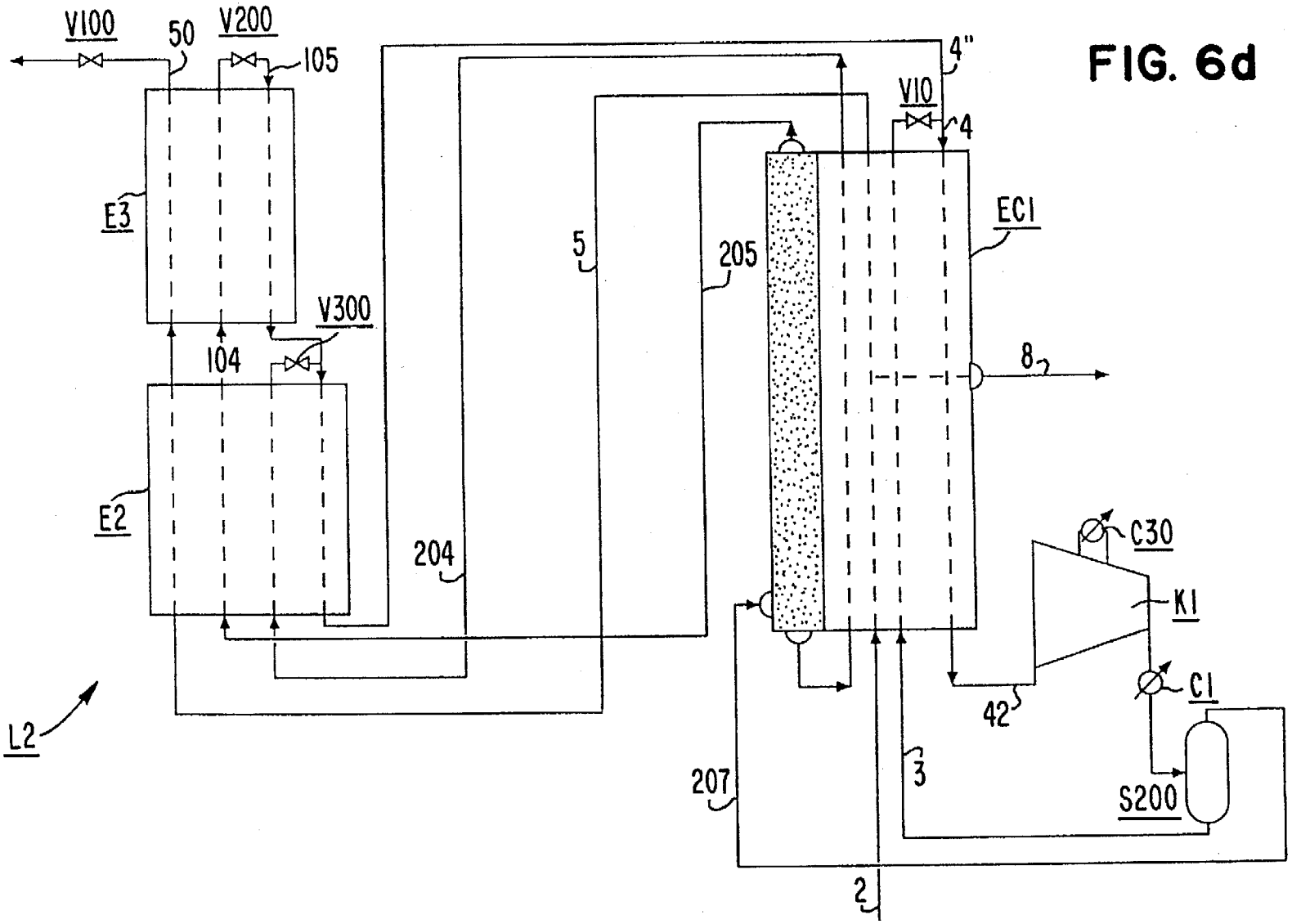

The line 20 intended for injecting the separation agent is situated at the head of the exchanger in the figure, but it may also be positioned at any other level of exchanger EC1 without departing from the scope of the invention. FIGS. 6C and 6D describe two other embodiments of the process according to the invention where cooling, at least in one stage of the liquefaction cycle, is carried out by means of a cooling agent obtained by implementing at least two stages of the process according to the invention.

In order to liquefy and to subcool the natural gas in exchangers E2 and E3, it is possible to use a liquid cooling mixture according to the process described in FIGS. 2B and 5B which, by vaporizing, allows the required cooling to be achieved.

To achieve cooling at the lowest temperatures required during the process, in exchanger E3 for example, a liquid cooling mixture fraction enriched in light constituents in relation to the initial mixture is required.

This enriched liquid cooling mixture is advantageously obtained from the initial vapour mixture consisting at least partly of a mixture of hydrocarbons, by carrying out at least the following two stages of the process according to the invention:

during a first stage, the initial gaseous mixture under pressure is cooled so as to condense it at least partly in order to produce a gas phase enriched in heavy hydrocarbons and a gas phase enriched in light hydrocarbons and, simultaneously, bringing into contact of each of these phases is achieved at least partly in a countercurrent flow so as to obtain, by matter transfer, a gas phase enriched in light hydrocarbons and a first liquid phase enriched in heavy hydrocarbons, and the two phases thus obtained are separated and the gas phase enriched in light hydrocarbons is sent to a second cooling stage in order to obtain a second liquid phase enriched in light hydrocarbons.

FIG. 6C describes a first embodiment example of the process according to the invention where the natural gas is cooled by means of two independent cooling cycles.

The cooling mixture used in the second cooling stage consists of methane, ethane, propane and nitrogen, and it is sent under pressure, in the vapour phase, through line 100, into exchanger EC1 where it is cooled and partly condensed.

The liquid phase thus obtained circulates downwards by gravity and is simultaneously contacted, in a countercurrent flow, by the gas phase circulating in an ascending flow.

A first propane-enriched liquid fraction is collected through line 206 at the bottom of device EC1. This liquid fraction is thereafter cooled in exchanger EC1 and fed through line 204 into exchanger E2 where it is cooled, expanded and vaporized to provide the cooling required in exchanger E2.

A vapour fraction enriched in methane and nitrogen is collected through line 205 at the top of exchanger E1 and fed into exchanger E2 where it is liquefied by forming a second liquid fraction. This second liquid fraction is subcooled in exchanger E3, expanded and vaporized to provide the cooling required in exchanger E3.

The natural gas flowing in through line 2 is cooled during a first stage in exchanger EC1. After this first cooling stage, a first liquid fraction is discharged through line 8.

The gaseous fraction produced during this first stage and leaving exchanger EC1 through line 5 is sent to exchangers E2 and E3. It leaves exchanger E3 in the liquefied form through line 50 and, after expansion through valve V 100, forms the LNG produced.

Cooling during the first stage is provided for example by a cooling cycle working with a mixture of fluids similar to that described in FIG. 2B.

FIG. 6D diagrammatically shows an embodiment example according to the invention where cooling of the natural gas is provided by a single cooling cycle.

The cooling mixture consisting of methane, ethane, propane, butane, pentane and nitrogen is sent under pressure, in the vapour phase, into condenser C1 which it leaves partly condensed. The two phases thus produced are separated in separator S 200.

The liquid fraction obtained at the bottom of the separator is thereafter sent through line 3 into exchanger EC1 where it is subcooled, then expanded and vaporized to provide the cooling required in exchanger EC1.

The vapour fraction obtained at the top of separator S 200 is sent through line 207 to exchanger EC1.

A liquid fraction depleted in methane and nitrogen is collected at the bottom of exchanger EC1 and fed into exchanger E2 through line 5, where it is subcooled, then expanded and vaporized to provide the cooling required in exchanger E2.

A vapour fraction enriched in methane and nitrogen is collected at the head of exchanger EC1 and fed into exchanger E2 where it is liquefied. It is thereafter subcooled in exchanger E3, then expanded and vaporized to provide the cooling required in exchanger E3.

Various technologies known to the man skilled in the art can be used to form the exchanger and the associated means or devices, some of which are described hereafter by way of non limitative examples.

Figure 7:
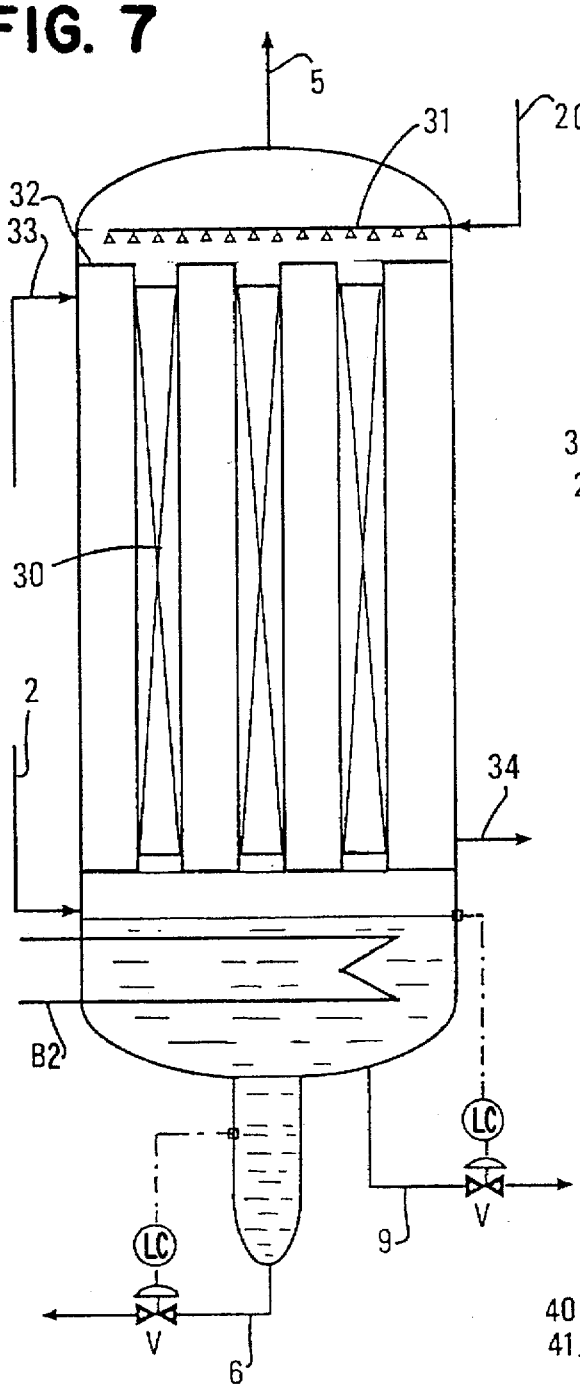
FIGS. 7, 8, 9 and 10 are examples of the technology used for manufacturing the exchanger and the separation means.

Exchanger EC1 is for example a shell-and-tube type exchanger such as that schematized in FIG. 7.

The gas to be processed flows in through line 2, circulates in an ascending flow inside vertical tubes 30. These tubes are preferably provided with a stacking for example a stacked packing allowing to improve contact between the ascending gas and the descending liquid fractions. The processed gas is discharged at the top through line 5.

For devices providing simultaneously dehydration and fractionation of the gas, the solvent introduced through line 20 (FIG. 6A) is sent into the various tubes 30 through a loading rack 31 and a distribution plate 32.

The liquid hydrocarbon phase, stabilized by heating by means of reboiler B2 situated in the lower part of exchanger EC1 foe example, is discharged under level control through line 9, and the aqueous phase is discharged under level control through line 6.

Cooling is provided by a heat-transfer fluid introduced into the exchanger through line 33 and discharged after heat exchange through line 34.

Figure 8:
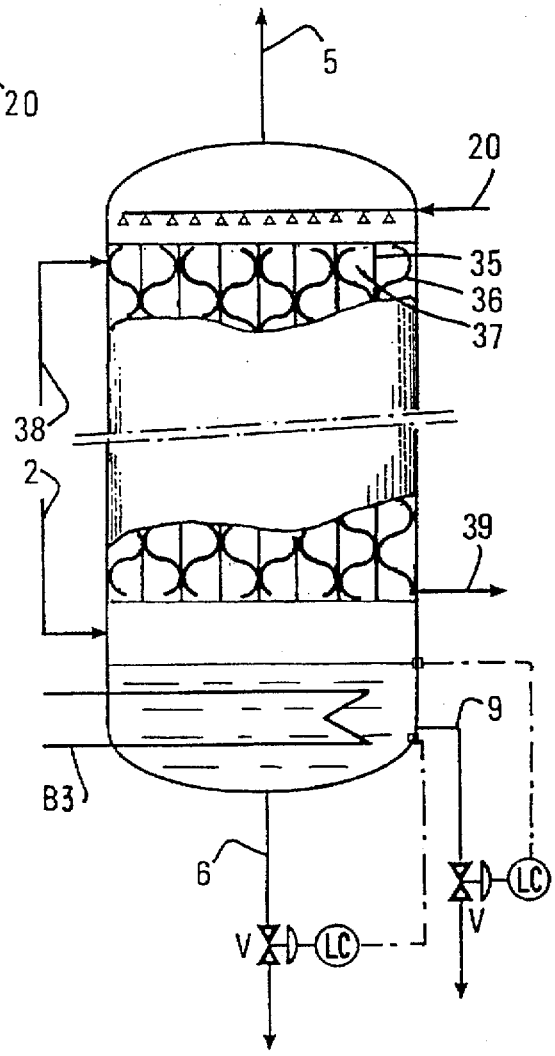

According to another technology, exchanger EC1 is a plate exchanger, made of brazed aluminium for example, such as that schematized in FIG. 8.

Such an exchanger is made up of an assembly of plane plates 35 between which intercalary corrugated plates 36 allowing to hold the assembly in position mechanically and to improve the heat transfer are inserted.

These plates delimit channels 37 in which the fluids taking part in the heat exchange during the process circulate.

The gas to be processed, introduced into the exchanger through line 2, circulates in channels 37 in an ascending flow while being progressively cooled by the heat-transfer fluid, The intercalary corrugated plates 36, that act as a stacked packing, promote contact between the ascending gas and the descending liquid fractions.

The solvent introduced through line 20, in the case of simultaneous dehydration and fractionation processes, is evenly distributed above channels 37 in which the gas to be processed circulates.

The coolant is fed into the exchanger at the level of the upper part thereof, through line 38 that opens substantially perpendicular to the plane of the section shown in FIG. 8 into a channel supply enclosure that is not shown in the figure. It is discharged after heat exchange through line 39 that runs perpendicular to the plane of the section shown in FIG. 8, the line being connected to a channel discharge enclosure that is not shown in the figure. The supply and discharge enclosures are devices known to the man skilled in the art allowing passage of the fluids circulating in each of the channels in the discharge line, and conversely distribution of the fluid coming from a line in the various channels.

The liquid hydrocarbon phase, possibly stabilized by reboiler B3, is discharged under level control (LC, V) through line 9 and the aqueous phase is discharged under level control through line 6.

Other types of plate exchangers can also be used, for example exchangers fitted with stainless steel plates welded to one another, either welded by butt welding or welded over the total surface thereof by means of a diffusion welding technique.

The man skilled in the art will of course be able to use all the known techniques available to improve contact between the phases and/or distribution of the fluids without departing from the scope of the invention.

Figure 9:
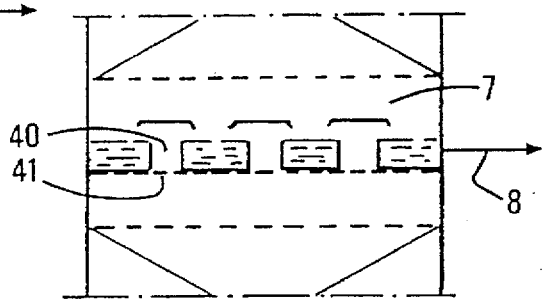

FIG. 9 diagrammatically shows an embodiment example of a tray allowing phases to be drawn off as a function of their nature, according to a process described in FIG. 3 for example.

Tray 7 comprises risers 40 allowing the gas to flow towards the upper part of the exchanger. The liquid phase that is gathered on this tray can be discharged through line 8 with a controlled flow rate, but it can also flow out by overflow towards the lower part of the exchanger. It is thus possible to collect only a fraction of the liquid phase coming from the upper part of the exchanger.

If two liquid phases are drawn off on the tray, for example a liquid hydrocarbon phase and an aqueous phase, they can be discharged at least partly separately. The aqueous phase, that is heavier, tends to accumulate at the bottom of the tray and it can be discharged for example through perforations 41 provided in the tray.

Any other mode of discharge of one or the other of the phases known to the man skilled in the art can be used without departing from the scope of the invention.

The liquefaction plant can include different plate exchangers.

Figure 10:
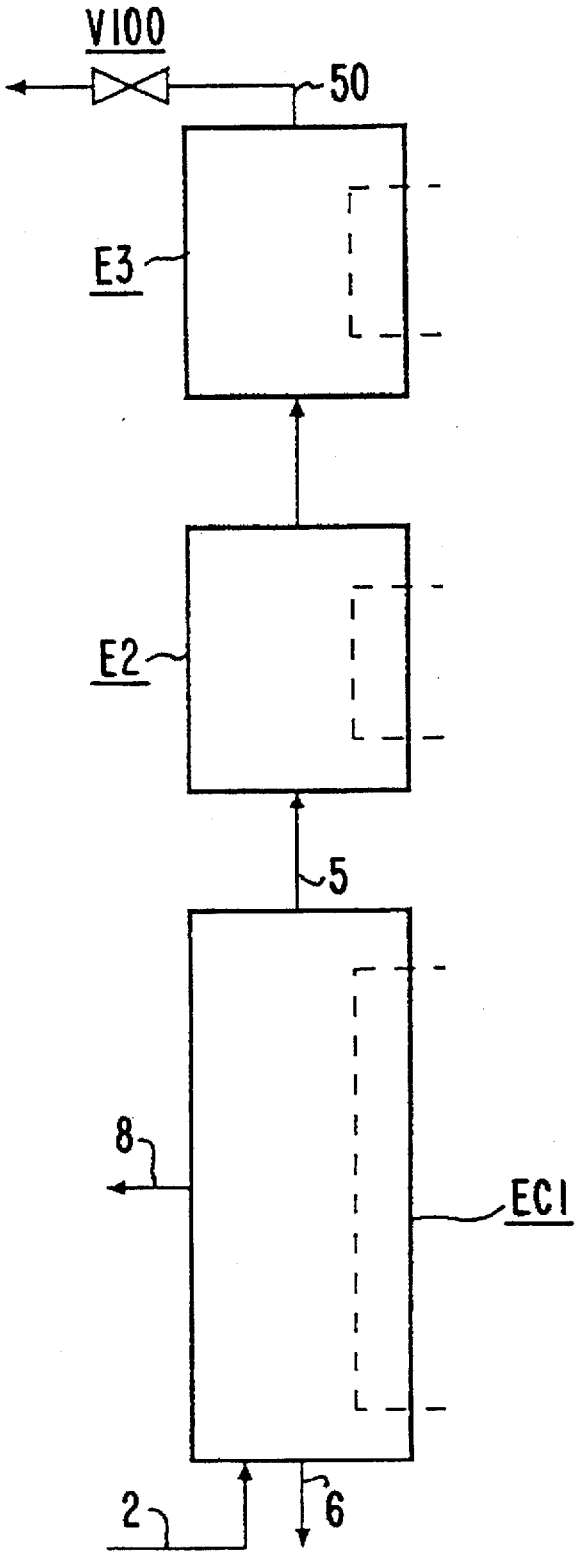

The device schematized in FIG. 10 can for example be used, in which the precooling stage is performed by means of a brazed aluminium plate exchanger, comprising drawing off a liquid fraction at the bottom through line 6 and drawing off a liquid fraction at an intermediate level through line 8, in which the final liquefaction and subcooling stages are performed in stainless steel plate exchangers.

We claim:

1. A process for liquefying a fluid consisting at least partly of a mixture of hydrocarbons, comprising:

introducing said mixture into a first zone;

cooling said mixture in said first zone under pressure to condense said mixture at least partly to produce a liquid phase and a gas phase, bringing into contact at least a fraction of said liquid phase and gas phase in a countercurrent flow in said first zone so as to obtain, by matter transfer, a gas phase enriched in light hydrocarbons and a first liquid phase enriched in heavy hydrocarbons; and sending the gas phase enriched in light hydrocarbons to a second cooling stage and cooling the gas phase enriched in light hydrocarbons so as to obtain a second liquid phase enriched in light hydrocarbons.

2. A process as claimed in claim 1, wherein, in said first zone, the gas phase ascends and is contacted with the liquid phase which descends.

3. A process as claimed in claim 1, wherein the cooling performed in the first zone is provided by an at least partly continuous countercurrent heat exchange over at least part of the zone of contact.

4. A process as claimed in claim 1, wherein in the first zone, at least two different liquid fractions are separated at different levels.

5. A process as claimed in claim 1, wherein the cooling in the first zone and in the second cooling stage are performed by means of two different cooling cycles operating each with a cooling mixture.

6. A process as claimed in claim 1, wherein the cooling in the first zone and in the second cooling stage are performed by means of a single cooling cycle operating with a cooling mixture.

7. A process as claimed in claim 1, further comprising introducing a solvent into the first zone.

8. A process as claimed in claim 1, wherein the mixture comprises natural gas.

9. A process for liquefying a natural gas as claimed in claim 8, wherein the cooling required for liquefying the natural gas is obtained at least partly by vaporization of at least a liquid fraction of a mixture of hydrocarbons resulting from a liquefaction stage.

10. A plant for liquefying a fluid comprising at least partly a mixture of hydrocarbons, comprising:

a. precooler for at least partly condensing the fluid and for separating the fluid into a gas phase enriched in light hydrocarbons and a liquid phase enriched in heavy hydrocarbons, the precooler comprising at least one first passage having an inlet, a gas phase outlet and a liquid phase outlet, and at least one second passage in heat transfer relationship with the at least one first passage, wherein the at least one second passage, the at least one first passage and the inlet, gas phase outlet and liquid phase outlet thereof are arranged to at least partially condense the fluid in the at least one first passage and to provide direct contact in countercurrent flow between the gas phase and the condensed liquid phase;

at least one line for delivering the fluid to the inlet of the at least one first passage;

a source of cooling fluid connected to the inlet of the at least one second passage; and a second cooling stage connected to the gas phase outlet of the at least one first passage for liquefying the gas phase enriched in light hydrocarbons.

11. A plant as claimed in claim 10, wherein said precooler comprises at least one draw-off means for drawing off liquid hydrocarbon fractions.

12. A plant as claimed in claim 11, comprising stabilization means for stabilizing said condensed liquid hydrocarbon fractions, said stabilization means being connected to said draw-off means.

13. A plant as claimed in claim 10, wherein said precooler comprises at least one injection means allowing injection of at least one fluid other than gas into said at least one first passage.

14. A plant as claimed in claims 10, wherein the precooler comprises a vertical plate exchanger in which the ascending gas to be processed and a liquid fraction flowing downwards by gravity are contacted.

15. A plant as claimed in claim 10, wherein the precooler comprises a brazed aluminum plate exchanger and the second cooling stage comprises a stainless steel plate exchanger.

* * * * *